US012313067B2

(12) United States Patent
Jin et al.

(10) Patent No.: US 12,313,067 B2
(45) Date of Patent: May 27, 2025

(54) DUAL GEROTOR APPARATUS, A POWERTRAIN ASSEMBLEY AND AN ELECTRIFIED VEHICLE

(71) Applicant: VALEO POWERTRAIN (NANJING) CO., LTD., Nanjing (CN)

(72) Inventors: Yejin Jin, Shanghai (CN); Kai Chen, Shanghai (CN); Guoqiang Sun, Shanghai (CN)

(73) Assignee: VALEO POWERTRAIN (NANJING) CO., LTD., Nanjing (CN)

( * ) Notice: Subject to any disclaimer, the term of this patent is extended or adjusted under 35 U.S.C. 154(b) by 46 days.

(21) Appl. No.: 18/042,140

(22) PCT Filed: Aug. 17, 2021

(86) PCT No.: PCT/CN2021/112984
§ 371 (c)(1),
(2) Date: Feb. 17, 2023

(87) PCT Pub. No.: WO2022/037569
PCT Pub. Date: Feb. 24, 2022

(65) Prior Publication Data

US 2024/0011483 A1 Jan. 11, 2024

(30) Foreign Application Priority Data

Aug. 19, 2020 (CN) ..... 202010836023.1

(51) Int. Cl.
*F04C 2/10* (2006.01)
*F04C 2/22* (2006.01)
(Continued)

(52) U.S. Cl.
CPC ..... *F04C 2/102* (2013.01); *F04C 2/10* (2013.01); *F04C 2/22* (2013.01); *F04C 11/001* (2013.01); *F04C 23/001* (2013.01)

(58) Field of Classification Search
CPC .... F04C 2/102; F04C 2/10; F04C 2/22; F04C 11/00; F04C 11/001; F04C 23/001
See application file for complete search history.

(56) References Cited

U.S. PATENT DOCUMENTS 2,775,204 A * 12/1956 Batten ..... F04C 15/008 D15/7
3,244,111 A * 4/1966 Shelhart ..... F04C 11/001 418/133
(Continued)

FOREIGN PATENT DOCUMENTS

CN 104863846 A 8/2015
DE 10 2015 204 833 A1 10/2015
(Continued)

OTHER PUBLICATIONS

International Search Report issued Jan. 5, 2022 in PCT/CN2021/112984 filed Aug. 17, 2021, 4 pages.

*Primary Examiner* — Christopher S Bobish
(74) *Attorney, Agent, or Firm* — Oblon, McClelland, Maier & Neustadt, L.L.P.

(57) ABSTRACT

The present disclosure relates to a dual gerotor apparatus. The dual gerotor apparatus comprises a housing configured to provide a first and second hydraulic fluid circuit sharing a single inlet and a single outlet. The dual gerotor apparatus further comprises a gerotor assembly coupling with a rotatable shaft, the gerotor assembly is configured to transfer a hydraulic fluid flowing through the first or second hydraulic fluid circuit from the single inlet to the single outlet. The gerotor comprises a first gerotor pump and a second gerotor pump, the first gerotor pump will be in operation when the rotatable shaft rotates in a first direction, and the second gerotor pump will be in operation when the rotatable shaft rotates in a second direction.

14 Claims, 4 Drawing Sheets

(51) Int. Cl.
*F04C 11/00* (2006.01)
*F04C 23/00* (2006.01)

(56) References Cited

U.S. PATENT DOCUMENTS

| | | | | |
|---|---|---|---|---|
| 6,386,836 | B1 * | 5/2002 | Johnson | F04C 11/001 417/310 |
| 6,860,724 | B2 * | 3/2005 | Cho | F04C 28/06 417/326 |
| 7,290,995 | B2 * | 11/2007 | Ohnishi | F04C 11/001 418/10 |
| 8,851,578 | B2 * | 10/2014 | Kawabata | F04C 11/001 303/10 |
| 2003/0026722 | A1 * | 2/2003 | Takagi | F04C 11/008 418/171 |
| 2012/0178574 | A1 * | 7/2012 | Grochowski | B60K 6/405 903/910 |
| 2013/0280041 | A1 * | 10/2013 | Kumamoto | F04D 1/00 415/116 |
| 2016/0123323 | A1 * | 5/2016 | Naiki | F01C 21/108 418/9 |
| 2016/0369796 | A1 * | 12/2016 | Pribanic | F04C 2/102 |

FOREIGN PATENT DOCUMENTS

| | | | | |
|---|---|---|---|---|
| JP | 2018-9539 | A | | 1/2018 |
| KR | 10-2015-0136436 | A | | 12/2015 |
| KR | 20150136436 | A | * | 12/2015 |
| KR | 10-1869874 | B1 | | 6/2018 |
| WO | WO 2018/135737 | A1 | | 7/2018 |

* cited by examiner

DUAL GEROTOR APPARATUS, A POWERTRAIN ASSEMBLEY AND AN ELECTRIFIED VEHICLE

FIELD OF THE INVENTION

Embodiments of the present disclosure relate generally to a dual gerotor apparatus, a powertrain assembly and an electrified vehicle comprising the dual gerotor apparatus.

BACKGROUND OF THE INVENTION

The trend towards designing and building fuel efficient, low emission vehicles has increased dramatically, this trend driven by concerns over the environment as well as increasing fuel costs. At the forefront of this trend has been the development of electrified vehicles, such as BEV, HEV, PHEV, Range extended EV, Fuel Cell etc., electrified vehicles that combine a relatively efficient combustion engine with an electric drive motor. Electrified vehicles can include components, particularly the powertrain system that needs appropriate solutions concerning active lubrication. Today, the electric pumps are used to for the powertrain system to ensure the active lubrication, otherwise, the electric pumps are costly. If the mechanical pumps are used instead, that would work fine in the vehicle forward direction but for the reverse direction. In the reverse direction, the mechanical pumps will suck air and always puts bubbles inside the hydraulic fluid circuit at the same time, which will cause a reduction of the active lubrication.

Therefore, it would be desirable if any improvements on the pump design for the active lubrication, particular for the powertrain system and for electrified vehicles, could be provided at least with simple configuration, high efficiency and low cost.

SUMMARY OF THE INVENTION

Aspects and advantages of the invention will be set forth in part in the following description, or may be obvious from the description, or may be learned through practice of the invention.

In accordance with one aspect disclosed herein, a dual gerotor apparatus is provided. The dual gerotor apparatus comprises a housing configured to provide a first and second hydraulic fluid circuit sharing a single inlet and a single outlet. The dual gerotor apparatus further comprises a gerotor assembly coupling with a rotatable shaft, the gerotor assembly is configured to transfer a hydraulic fluid flowing through the first or second hydraulic fluid circuit from the single inlet to the single outlet. The gerotor comprises a first gerotor pump and a second gerotor pump, the first gerotor pump will be in operation when the rotatable shaft rotates in a first direction, and the second gerotor pump will be in operation when the rotatable shaft rotates in a second direction.

In accordance with another aspect disclosed herein, a powertrain assembly comprising the dual gerotor apparatus according to the above described is provided.

In accordance with another aspect disclosed herein, an electrified vehicle comprising the dual gerotor apparatus according to the above described is provided.

These and other features, aspects, and advantages of the present disclosure will become better understood with reference to the following detailed description. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
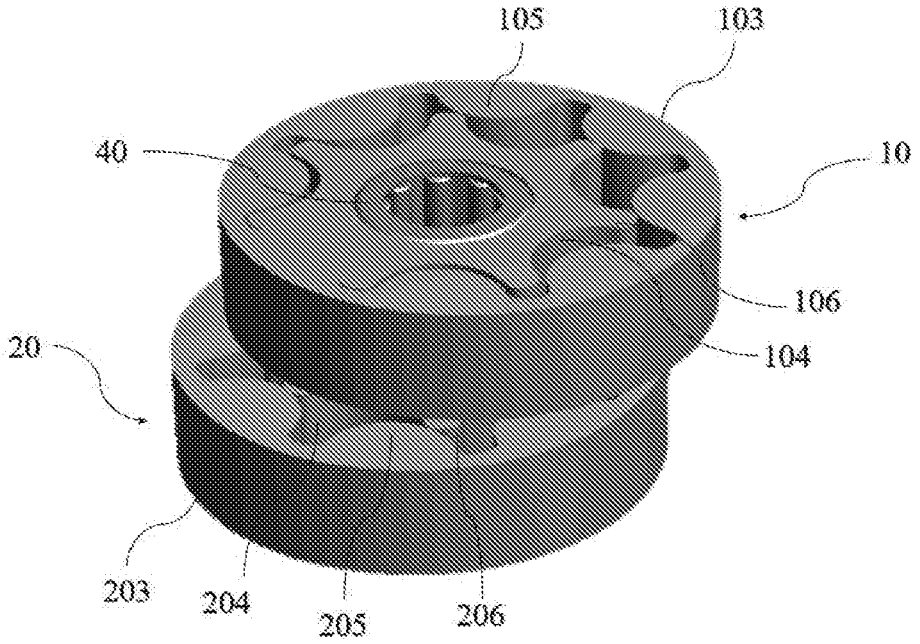
FIG. 1 is a schematic view of a gerotor assembly in accordance with an exemplary aspect of the present disclosure.

Reference will now be made to in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "a", "an" and "the" are intended to mean that there are one or more of the elements unless the context clearly dictates otherwise. The terms "comprising", "including" and "having" are intended to be inclusive and mean that there may be additional elements other than the listed elements. The terms "first" and "second" may be used interchangeably to distinguish one component from another and are not intended to signify location or importance of individual components.

Referring now to the drawings, wherein identical numerals indicate the same elements throughout the figures, FIG. 1 shows a gerotor assembly in accordance with one embodiment of the present disclosure. The gerotor assembly comprises a first gerotor pump 10 and a second gerotor pump 20.

As illustrated in FIG. 1, the first gerotor pump 10 comprises a first inner gerotor 104 and a first outer gerotor 103, the first inner gerotor 104 is able to be disposed within the first outer gerotor 103 and rotate in engagement with the first outer gerotor 103. In one embodiment, the first outer gerotor 103 may include an internal gear 105 corresponding to an external gear 106 provided by the first inner gerotor 104. The number of the internal gear 105 may be corresponding to the number of the external gear 106, in one embodiment, the number of the internal gear 105 may be smaller than that of the external gear 106.

The second gerotor pump 20 can have similar configuration with that of the first gerotor pump 10. Referring to FIG. 1, the second gerotor pump 20 may comprise a second inner gerotor 204 and a second outer gerotor 203, the second inner gerotor 204 is able to be disposed within the second outer gerotor 203 and rotate in engagement with the first outer gerotor 103. In one embodiment, the second outer gerotor 203 may include an internal gear 205 corresponding to an external gear 206 provided by the second inner gerotor 204. The number of the internal gear 205 may be corresponding to the number of the external gear 206, in one embodiment, the number of the internal gear 205 may be smaller than that of the external gear 206.

A bearing 40 can be provided with a central portion of both the first and second gerotor pumps 10, 20, respectively, configured for coupling with a driving shaft so that the pair of gerotor pumps could be driven to be rotatable around the shaft, further, with the rotation of the first and second gerotor pumps 10, 20, a hydraulic fluid with appropriated pressure will be generated, respectively. In one embodiment, the first gerotor pump 10 may be design to be the same size as the second gerotor pump 20. In one embodiment, the first gerotor pump 10 may be design to be smaller than the second gerotor pump 20 for supplying a hydraulic fluid with lower pressure.

Figure 2:
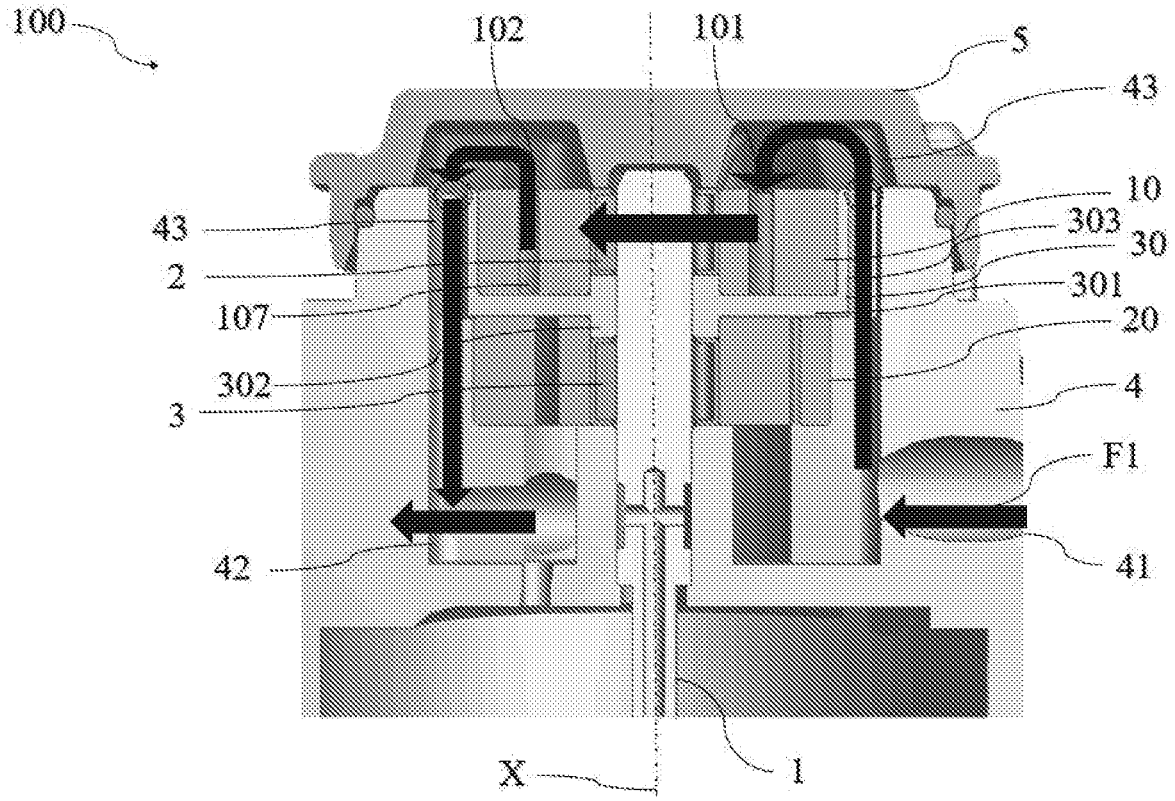
FIG. 2 is a schematic view of the gerotor assembly coupling with a rotatable shaft in accordance with an exemplary aspect of the present disclosure, showing one exemplary configuration of the first hydraulic fluid circuit when the first gerotor pump is in operation.

Referring to FIG. 2, the pair of gerotor pumps is able to be driven by a rotatable shaft 1, the first gerotor pump 10 and the second gerotor pump 20 are coupling with the rotatable shaft 1 and arranged side by side along an axial direction X. Further, a first one-way clutch 2 is provided for engaging with the first gerotor pump 10 while a second one-way clutch 3 is provided for engaging with the second gerotor pump 20, such that when the rotatable shaft 1 rotates in a first direction, e.g., in a forward direction, the first gerotor pump 10 supported by the first one-way clutch 2 will be in operation, and when the rotatable shaft 1 rotates in a second direction, e.g., in a reverse direction, the second gerotor pump 20 supported by the first one-way clutch 3 will be in operation. With such configuration, the pair of gerotor pumps could be in operation for different directions of the rotation and keep generating hydraulic fluids with different flow rates as required.

Still referring to FIG. 2, a housing 4 is provided for containing the pair of gerotor pumps 10, 20 and the rotatable shaft 1, particularly, the rotatable shaft 1 would be firstly installed in the housing 4, then the pair of gerotor pumps 10, 20 may be inserted into the housing 4 via the rotatable shaft 1. Further, a cover 5 is provided onto one end portion of the rotatable shaft 1 for enclosing the housing 4 and the pair of gerotor pumps 10, 20.

Figure 3:
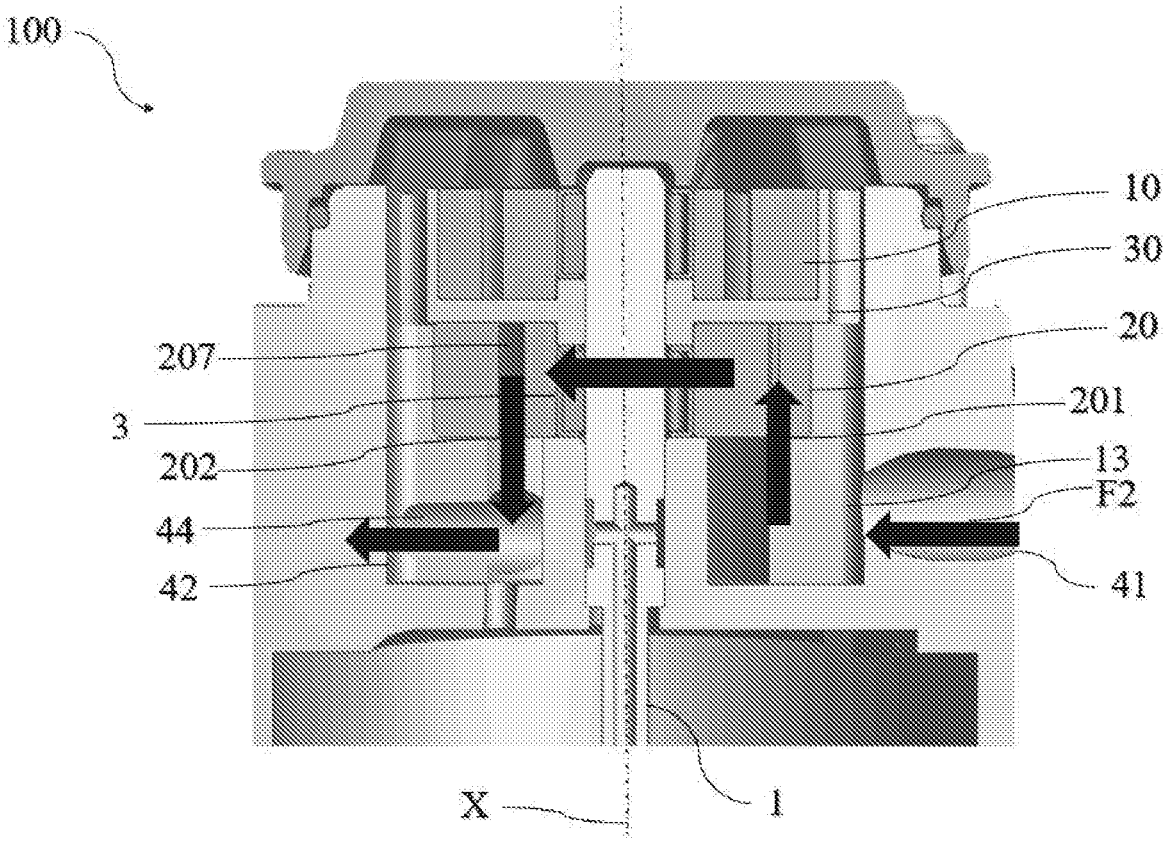
FIG. 3 is a schematic view of the gerotor assembly integrated with rotatable shaft in accordance with an exemplary aspect of the present disclosure, showing one exemplary configuration of the second hydraulic fluid circuit when the second gerotor pump is in operation.

A separation element 30 can be provided between the first and second gerotor pumps 10, in an axial direction, referring now to FIGS. 2 to 3 showing one exemplary configuration of the dual gerotor apparatus 100, so that the hydraulic fluids F1, F2 generated by the first and second gerotor pumps 10, 20 can be separated from each other.

Figure 4:
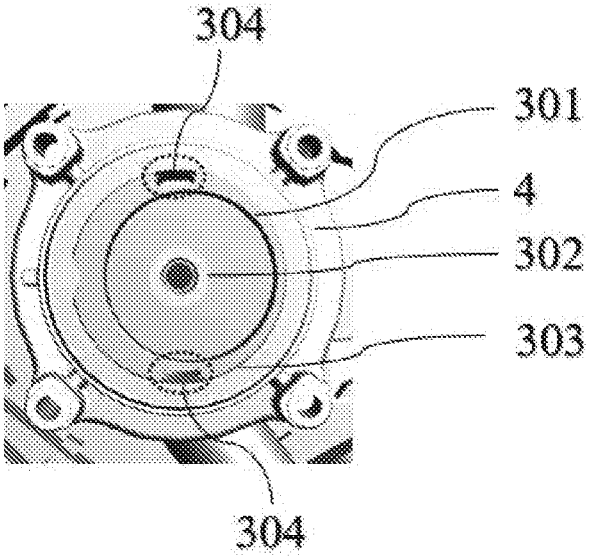
FIG. 4 is a top view of the dual gerotor apparatus in accordance with an exemplary aspect of the present disclosure, showing one exemplary configuration of the separation element.

Referring to FIGS. 2 and 4, in the illustrated embodiment, the separation element 30 comprises a body portion 301, arranged between the radial surfaces of the first and second gerotor pumps and generally forming as an annular plate. The body portion 301 provides an isolation of the fluid communication between the first gerotor pump 10 and the second gerotor pump 20.

The separation element 30 further comprises an inner circumferential boss 302 axially extending from the body portion 301 and along both an inner periphery of the first gerotor pump and an inner periphery of the second gerotor pump 20, the inner circumferential boss 302 is coupling with the shaft 1 such that it can provide with centering for the first and second gerotor pump 10, 20.

The separation element 30 further comprises an outer circumferential wall 303 surrounding the outer circumferential surface of the first gerotor pump 10, the wall 303 being configured for limiting a radial displacement for the first gerotor pump 10 installed within the housing 4 and for directing a hydraulic fluid flowing from the fluid channel inside the housing 4 into the first gerotor pump 10. As illustrated in FIG. 4, in one embodiment, the outer circumferential wall 303 can have two grooves 304 along its edge and being align with the fluid channel inside the housing 4 so that a hydraulic fluid could flow there through.

Referring back to FIG. 2, fluid channels are provided within the housing 4, further, a single inlet 41 and a single outlet 42 are provided onto the housing 4 for a flow F1, F2 of hydraulic fluid. A first hydraulic fluid circuit 43 is formed by the housing 4, the separation element 30 and the cover 5. Particularly, when the first gerotor pump 10 works, e.g., in the circumstances that an electrified vehicle moves in a backward direction, a hydraulic fluid F1 will be formed and provided from the single inlet 41 of the housing 4, the hydraulic fluid F1 will be directed into an inlet 101 of the first gerotor pump 10 via one of the grooves 304 of the separation element 30, the hydraulic fluid F1 will flow through a fluid passage 107 within the first gerotor pump 10 and be discharged from an outlet 102 of the first gerotor pump 10, then will be transferred towards the single outlet 42 of the housing 4 via the other one of the grooves 304 of the separation element 30.

Referring to FIG. 3 showing a second hydraulic fluid circuit 44, when the second gerotor pump 20 works, e.g., in the circumstances that an electrified vehicle moves in a forward direction, a hydraulic fluid F2 will be formed and provided from the single inlet 41 of the housing 4, the hydraulic fluid F2 will be directed into an inlet 201 of the second gerotor pump 20, flow through a fluid passage 207 within the second gerotor pump 20 and be discharged from an outlet 202 of the second gerotor pump 20, then will be transferred towards the single outlet 42 of the housing 4.

With the configuration as described above, the dual gerotor apparatus will be always actuated, e.g., upon the vehicle moves in a forward or reverse direction, and keep generating a hydraulic fluid with appropriated pressure for active lubrication, e.g., for a powertrain assembly of an electrified vehicle. Additionally, the architecture of the dual gerotor apparatus with one-way clutch for each gerotor is simple and costs low. Moreover, the one-way design will not introduce bubbles into the hydraulic fluid circuit, the efficiency of the active lubrication may not be reduced.

This written description uses examples to disclose the embodiments of the present disclosure, including the best mode, and also to enable any person skilled in the art to practice embodiments of the present disclosure, including making and using any devices or systems and performing any incorporated methods. The patentable scope of the embodiments described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A dual gerotor apparatus, comprising:

a housing configured to provide a first and second hydraulic fluid circuit sharing a same single fluid inlet and a same single fluid outlet;

a gerotor assembly coupling with a rotatable shaft, the gerotor assembly includes a first gerotor pump and a second gerotor pump; and a separation element disposed between the first gerotor pump and the second gerotor pump in an axial direction, wherein the gerotor assembly is configured to transfer a hydraulic fluid flowing through the first or second hydraulic fluid circuit from the single fluid inlet to the single fluid outlet, and wherein the first gerotor pump is configured to be in operation when the rotatable shaft rotates in a first direction, and the second gerotor pump is configured to be in operation when the rotatable shaft rotates in a second direction, wherein the separation element is configured for isolating the fluid communication between the first and second gerotor pumps and for forming the first hydraulic fluid circuit, wherein the separation element comprises an outer circumferential wall axially extending from a body portion of the separation element and along an outer periphery the first gerotor pump, the outer circumferential wall is configured for limiting a radial displacement for the first gerotor pump and for directing the first hydraulic fluid flowing through the first hydraulic fluid circuit, and wherein a portion of the first hydraulic circuit is positioned between an outer surface of the outer circumferential wall and an inner circumferential surface of the housing.

2. The dual gerotor apparatus according to claim 1, further comprising a first one-way clutch configured for supporting the first gerotor pump onto the rotatable shaft and driving the first gerotor pump when the rotatable shaft rotates in the first direction; and a second one-way clutch configured for supporting the second gerotor pump onto the rotatable shaft and driving the second gerotor pump when the rotatable shaft rotates in the second direction.

3. The dual gerotor apparatus according to claim 1, wherein the first gerotor pump comprises a first rotatable inner gerotor disposed within a first rotatable outer gerotor, a first fluid passage with a first inlet and a first outlet being communication with the first hydraulic fluid circuit;

the second gerotor pump comprises a second rotatable inner gerotor disposed within a second rotatable outer gerotor, a second fluid passage with a second inlet and a second outlet being communication with the second hydraulic fluid circuit.

4. The dual gerotor apparatus according to claim 3, wherein the separation element comprises an inner circumferential boss axially extending from the body portion of the separation element and along both an inner periphery of the first gerotor pump and an inner periphery of the second gerotor pump, the inner circumferential boss is configured for centering both the first and second gerotor pump.

5. The dual gerotor apparatus according to claim 1, wherein the first gerotor pump is designed to be smaller than the second gerotor pump for supplying a lower pressure hydraulic fluid.

6. The dual gerotor apparatus according to claim 3, further comprising a cover configured for enclosing the housing and the gerotor assembly in one end of the rotatable shaft and for forming the first hydraulic fluid circuit.

7. The dual gerotor apparatus according to claim 6, wherein the first hydraulic fluid circuit is formed by the housing, the separation element and the cover, and configured for directing the first hydraulic fluid provided by the single inlet into the first gerotor pump and transferring the first hydraulic fluid discharged from the first gerotor pump towards the single outlet.

8. A powertrain assembly, comprising the dual gerotor apparatus according to claim 1.

9. An electrified vehicle, comprising the dual gerotor apparatus according to claim 1.

10. A powertrain assembly, comprising the dual gerotor apparatus according to claim 2.

11. A powertrain assembly, comprising the dual gerotor apparatus according to claim 3.

12. A powertrain assembly, comprising the dual gerotor apparatus according to claim 4.

13. An electrified vehicle, comprising the dual gerotor apparatus according to claim 2.

14. An electrified vehicle, comprising the dual gerotor apparatus according to claim 3.

* * * * *